US005459444A

United States Patent [19]

Baer et al.

[11] Patent Number: 5,459,444

[45] Date of Patent: Oct. 17, 1995

[54] CIRCUIT BREAKER FOR USE IN WALL MOUNTED PLUG

[75] Inventors: Mark Baer, Linden; L. Lent Crevling; James Robitaille, both of Williamsport, all of Pa.

[73] Assignee: Felchar Manufacturing Corporation, Kirkwood, N.Y.

[21] Appl. No.: 326,046

[22] Filed: Oct. 19, 1994

Related U.S. Application Data

[63] Continuation of Ser. No. 947,286, Sep. 17, 1992, abandoned, which is a continuation-in-part of Ser. No. 701,130, May 16, 1991, abandoned.

[51] Int. Cl.[6] ..... H01H 73/00

[52] U.S. Cl. ..... 335/18; 361/42

[58] Field of Search ..... 335/18; 361/42–50

[56] References Cited

U.S. PATENT DOCUMENTS

| | | |
|---|---|---|
| Re. 33,087 | 10/1989 | Bradford et al. . |
| 3,287,603 | 11/1966 | Sosnoski . |
| 3,566,189 | 2/1971 | Wilson et al. . |
| 3,599,043 | 8/1971 | Biedermann . |
| 3,611,038 | 10/1971 | Benham . |
| 3,614,533 | 10/1971 | Douglas et al. . |
| 3,621,334 | 11/1971 | Burns et al. . |
| 3,676,737 | 7/1972 | Garzon . |
| 3,706,007 | 12/1972 | Wu . |
| 3,708,723 | 1/1973 | Shand et al. . |
| 3,723,815 | 3/1973 | Ambler et al. . |
| 3,780,348 | 12/1973 | Loukidis . |
| 3,932,790 | 1/1976 | Muchnick . |
| 3,944,891 | 3/1976 | McDonald et al. . |
| 4,004,201 | 1/1977 | DePuy . |
| 4,020,394 | 4/1977 | Potash . |
| 4,024,436 | 5/1977 | Adams . |
| 4,063,299 | 12/1977 | Munroe . |
| 4,068,276 | 1/1978 | Pintell . |
| 4,081,851 | 3/1978 | Stevenson et al. . |
| 4,081,852 | 3/1978 | Coley et al. . |
| 4,124,835 | 11/1978 | Cahill, Jr. . |
| 4,131,929 | 12/1978 | Moran . |
| 4,187,523 | 2/1980 | Gray . |
| 4,197,567 | 4/1980 | Dietz et al. . |
| 4,216,516 | 8/1980 | Howell . |
| 4,288,694 | 9/1981 | Ahrons . |
| 4,306,329 | 12/1981 | Yokoi . |
| 4,320,433 | 3/1982 | Yamaki . |
| 4,331,149 | 5/1982 | Gonser . |
| 4,344,100 | 8/1982 | Davidson et al. . |
| 4,358,808 | 11/1982 | Praeg . |
| 4,358,809 | 11/1982 | Blok . |
| 4,370,630 | 1/1983 | Capek et al. . |

(List continued on next page.)

FOREIGN PATENT DOCUMENTS

| | | |
|---|---|---|
| 2203907 | 10/1988 | United Kingdom . |
| 2204198 | 11/1988 | United Kingdom . |
| 2204736 | 11/1988 | United Kingdom . |

*Primary Examiner*—Lincoln Donovan
*Attorney, Agent, or Firm*—Marshall, O'Toole, Gerstein, Murray & Borun

[57] ABSTRACT

A circuit breaker includes a normally open switch having first and second contacts and a movable leaf spring supporting the first contact. The leaf spring is normally oriented in a first position wherein the first contact is not in electrical contact with the second contact. The leaf spring is deformable into a second position wherein the first contact is in electrical contact with the second contact. An armature is movable between an open and a closed position and is located adjacent an electric coil which generates a magnetic field which moves the armature into the closed position when the coil is energized. The leaf spring biases the armature into its open position when the coil is not energized. The armature causes the leaf spring to deform into the second position, so as to place the first contact into electrical contact with the second contact, when the coil is energized. A housing for the circuit breaker is also provided, and the circuit breaker is a modular unit which may be assembled and tested before being installed in the housing. The housing has an aperture or window for viewing the position of the armature.

17 Claims, 11 Drawing Sheets

U.S. PATENT DOCUMENTS 4,412,193 10/1983 Bienwald et al. .
4,490,590 12/1984 Matsuda .
4,518,945 5/1985 Doyle et al. .
4,546,309 10/1985 Kang et al. .
4,567,456 1/1986 Legatti .
4,568,997 2/1986 Bienwald et al. .
4,574,324 3/1986 Packard .
4,591,941 5/1986 Gruchalla et al. .
4,595,894 6/1986 Doyle et al. .
4,598,331 7/1986 Legatti .
4,709,293 11/1987 Gershen et al. .
4,710,751 12/1987 Webster .
4,719,437 1/1988 Yun .
4,739,274 4/1988 Kimball et al. .
4,739,275 4/1988 Kimball et al. .
4,752,853 6/1988 Matsko et al. .
4,802,052 1/1989 Brant et al. .
4,816,957 3/1989 Irwin .
4,827,231 5/1989 Cheski et al. .
4,837,519 6/1989 Lopetrone et al. .
4,870,527 9/1989 Zaleski .
4,884,034 11/1989 Guzman .
4,929,901 5/1990 Kimball et al. .
5,166,853 11/1992 Gershen et al. .
5,177,657 1/1993 Baer et al. .
5,184,271 2/1993 Doyle et al. .
5,202,662 4/1993 Bienwald et al. .

CIRCUIT BREAKER FOR USE IN WALL MOUNTED PLUG

RELATED APPLICATION

This is a Continuation of U.S. application Ser. No. 07/947,286, filed Sep. 17, 1992, now abandoned which is a Continuation-in-Part of application Ser. No. 07/701,130, filed May 16, 1991 now abandoned.

BACKGROUND OF THE INVENTION

The present invention is directed towards an electromechanical circuit breaker, and more particularly, an electromechanical circuit breaker which is particularly useful in plugs adapted to engage wall-mounted receptacles.

It has become increasingly common to utilize ground fault interrupter circuits in household appliances to protect against hazardous electric shock to the consumer. Such ground fault circuits are particularly important in connection with electrically powered appliances operated around water, such as pressurized water sprayers and appliances utilized in the bathroom.

An integral part of a ground fault interrupter circuit is an electromechanical circuit breaker which interrupts the application of electric power to the load whenever a fault condition is detected. When such a circuit breaker is used in connection with a household appliance, it is particularly important that the circuit breaker be small, inexpensive, simple, and reliable. The use of a compact circuit breaker is particularly important when it is mounted in a standard wall plug holding the male plug blades which fit into a standard female wall receptacle.

It is therefore a general object of the present invention to provide an improved ground fault interrupter which includes the foregoing important features.

The present invention is also directed towards a modular circuit breaker design which can be tested prior to being installed into a housing or other enclosure.

While the circuit breaker of the present invention is particularly useful in connection with ground fault interrupter circuits housed in a wall-mounted plug of an electrical appliance, the present invention is not limited to such applications.

SUMMARY OF THE INVENTION

A circuit breaker in accordance with the present invention comprises:

- a normally open switch including first and second contacts and a movable leaf spring supporting the first contact, the leaf spring being normally oriented in a first position wherein the first contact is out of electrical contact with the second contact and being deformable into a second position wherein the first contact is in electrical contact with the second contact;
- an armature movable between an open position and a closed position;
- an electrical coil for generating a magnetic field which moves the armature into the closed position when the coil is energized;
- the leaf spring biasing the armature into its open position when the coil is not energized, the armature causing the leaf spring to deform into the second position, so as to place the first contact into electrical contact with the second contact, when the coil is energized.

In one embodiment, the circuit breaker also includes a support member upon which the coil is mounted, and the armature is hingedly connected to the support member. A cam member is coupled between the armature and the leaf spring and has a cam surface which contacts the support member. The cam member is moved into the first position by the leaf spring when the coil is not energized. When the cam member is in its first position, the armature is moved to its open position and the normally open switch is open. The cam member is moved into a second position by the armature when the coil is energized. In this position, the cam member causes the leaf spring to move into its second position so as to close the normally open switch.

In another embodiment, the armature is removably coupled to the support member by a tongue and groove arrangement and the tongue is normally biased into the groove by the leaf spring. A conductive core extends through the coil and cooperates with the support member and armature, which are also formed of conductive materials, to define a magnetic path for flux generated by the coil when the coil is energized.

The coil may be wound on a nonconductive bobbin which is supported on the support member. The conductive core extends through the bobbin and is separated from the coil by the bobbin.

The support member may be mounted on a circuit board via an insulation member which supports the support member at a position spaced from the circuit board.

In still another embodiment, the circuit breaker and circuit board are housed in a wall plug housing having a viewing opening therein. A portion of the armature which lies adjacent to the viewing opening when the armature is in one of the open and closed positions is preferably painted with a highly visible paint so as to provide a visual indication through the opening of whether the normally open switch is in the open or closed position.

BRIEF DESCRIPTION OF THE DRAWINGS

For the purpose of illustrating the invention, there is shown in the drawings forms which are presently preferred, it being understood, however, that the invention is not limited to the precise arrangement and instrumentality shown.

DETAILED DESCRIPTION OF THE DRAWINGS

Figure 1:
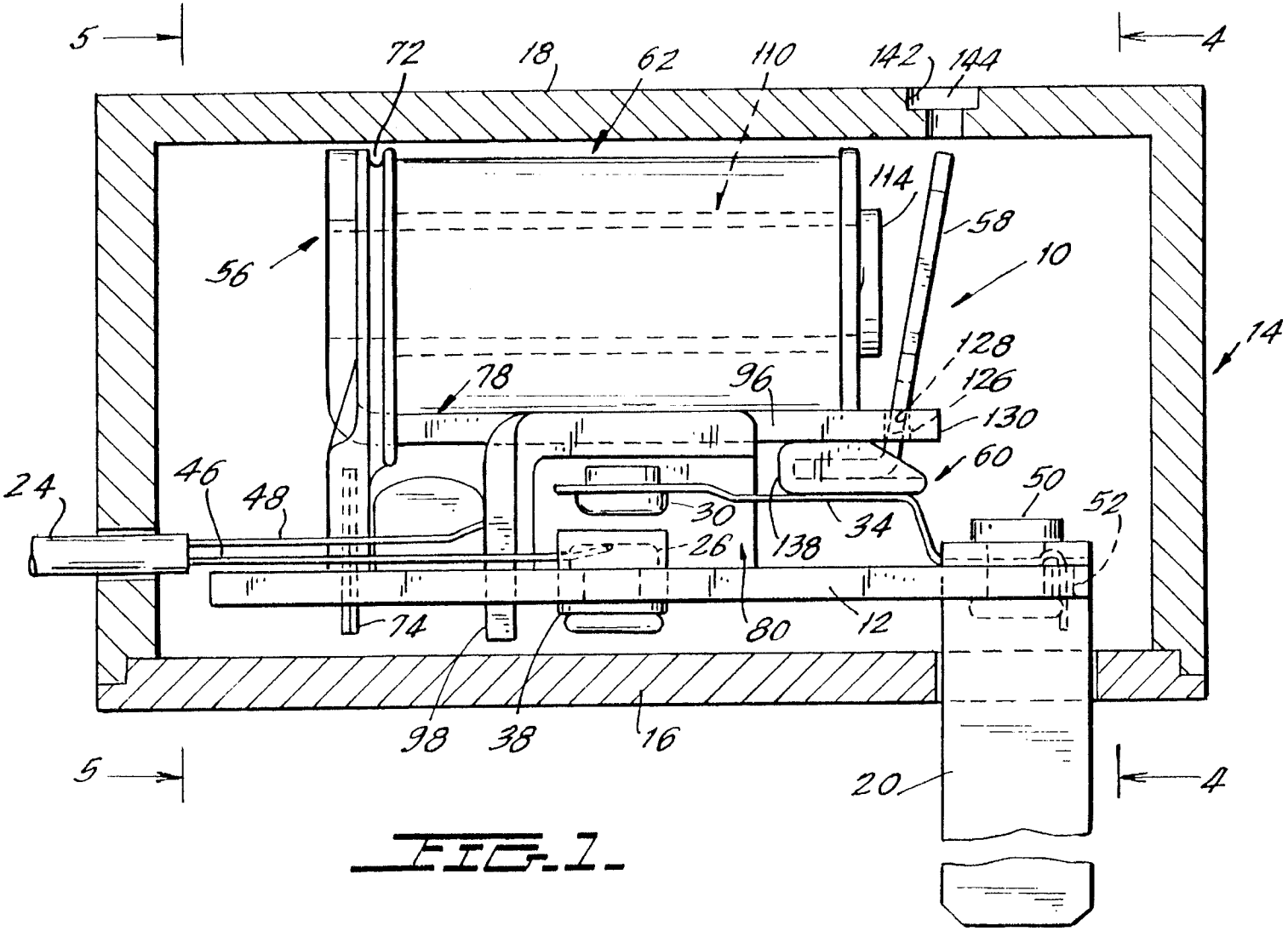
FIG. 1 is a side view of a circuit breaker according to the present invention located in the housing of a wall plug, part of the housing of the wall plug being broken away to show interior parts, with the circuit breaker in the open position.

Referring now to the drawings wherein like numerals indicate like elements, there is shown in FIG. 1 a circuit breaker constructed in accordance with the principles of the present invention and designated generally by the numeral 10. In the present embodiment, circuit breaker 10 is mounted on a printed circuit board 12 which also supports electronic components forming part of the ground fault interrupter circuit which drives the circuit breaker 10. The preferred structure of the ground fault interrupter circuit is disclosed in application Ser. Nos. 07/701,651 (now U.S. Pat. No. 5,177,657 issued Jan. 5, 1993) and 07/918,249, both entitled GROUND FAULT INTERRUPTER CIRCUIT WITH ELECTRONIC LATCH which are assigned to the assignee of the present invention. The disclosures of the foregoing applications are incorporated herein by reference.

In one embodiment, the circuit board 12 and the electronic components therein, including the circuit breaker 10, are mounted in a plug housing 14 adapted to engage a wall-mounted receptacle.

The circuit board 12 is mounted to the plug housing 14 in any suitable manner. The plug housing 14 preferably includes a base portion 16 and a cover portion 18. The circuit board 12 is initially mounted on the base portion 16 of the housing 14 and then the cover portion 18 is coupled to the base portion 16 to form an enclosure housing the circuit breaker 10.

Figure 4:
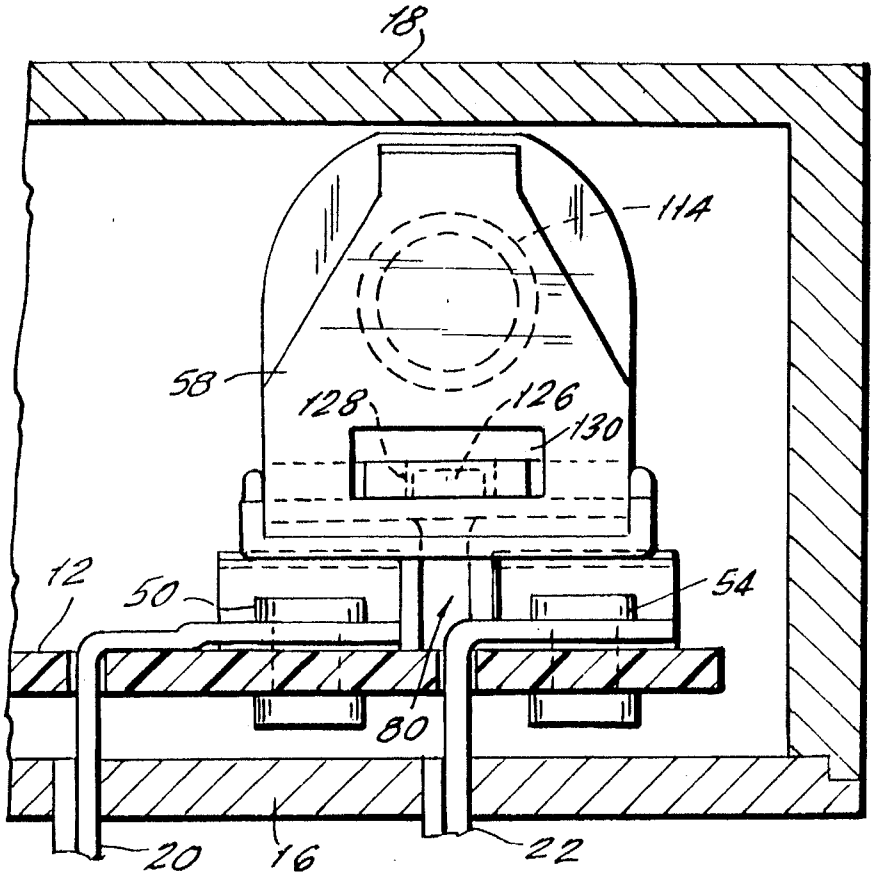
FIG. 4 is a front view of the circuit breaker of FIG. 1 taken along lines 4—4 of FIG. 1.

The circuit breaker 10 is coupled between a pair of plug blades 20, 22 (FIGS. 1 and 4) which are adapted to be inserted into a standard female wall receptacle, and a power cord 24 which extends through an opening in housing 14 and is coupled to a load such as a household appliance.

Figure 2:
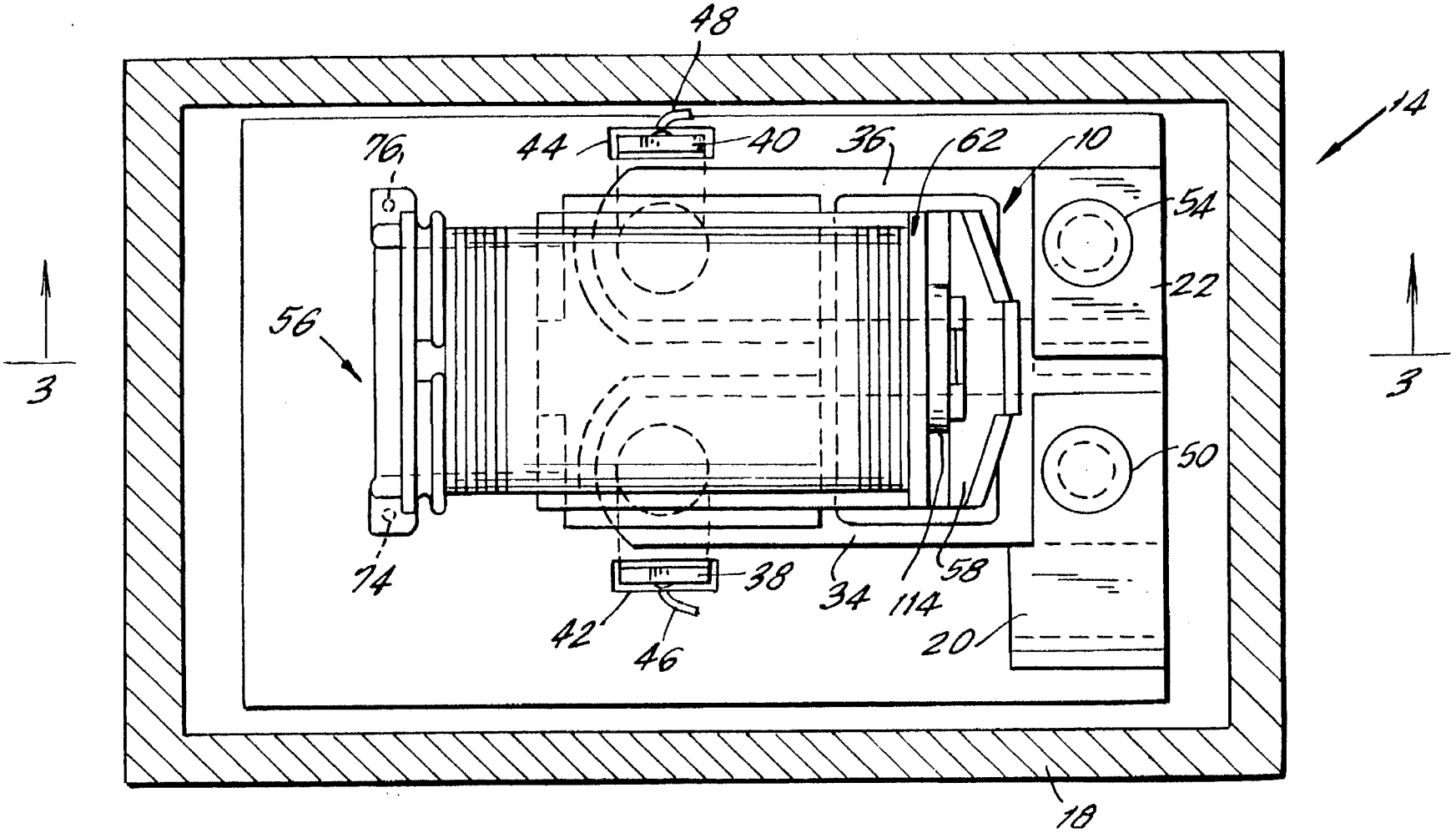
FIG. 2 is a top view of the circuit breaker of FIG. 1, the top portion of the plug housing being broken away.
Figure 5:
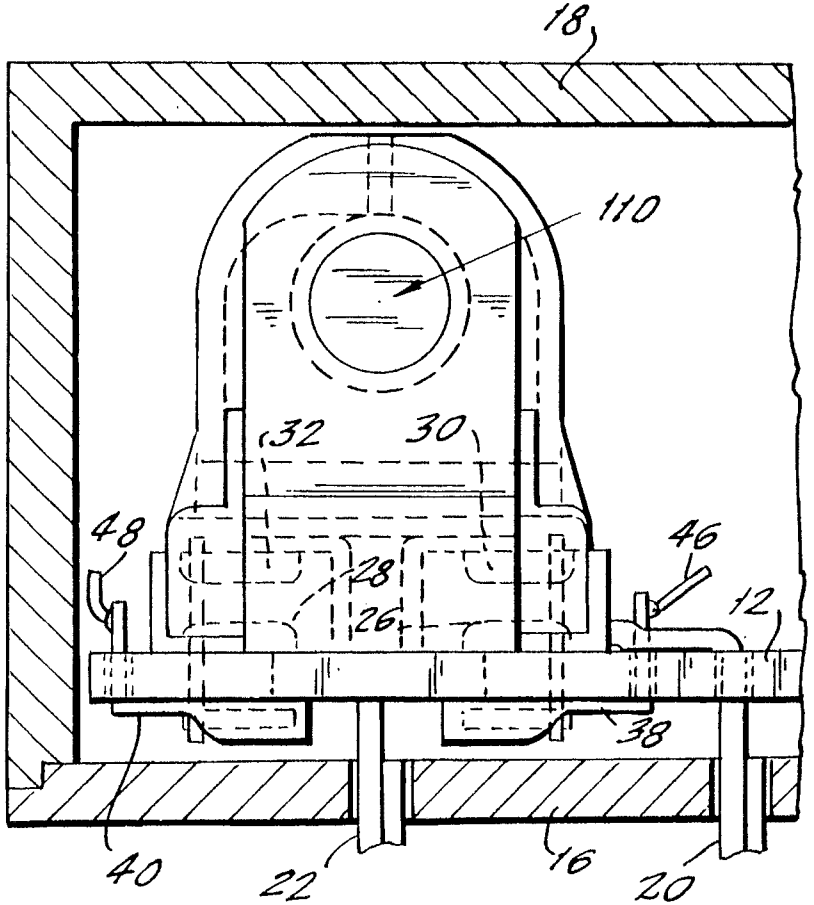
FIG. 5 is a rear view of the circuit breaker of FIG. 1 taken along lines 5—5 of FIG. 1.

As best viewed in FIGS. 1, 2, and 5, the circuit breaker 10 includes a pair of stationary contacts 26, 28 and a pair of movable contacts 30, 32 coupled to respective leaf springs 34, 36. The stationary contact 26, movable contact 30, and leaf spring 34 together define a first normally open switch. The stationary contact 28, the movable contact 32, and the leaf spring 36 together define a second normally open switch. The first normally open switch is coupled between the plug blade 20 and a first lead 46 of the power cord 24. The second normally open switch is coupled between the plug blade 22 and a second lead 48 of the power cord 24. In the normally open position, these switches cut off power to the load coupled to power cord 24. In the closed position (illustrated in FIG. 8), the switches couple electrical power to the load.

Stationary contacts 26, 28 are preferably defined by respective eyelets which are riveted to circuit board 12 along with respective lugs 38, 40. Each of the lugs 38, 40 includes an annular portion which is located below circuit board 12 and has an opening through which its respective stationary contact is riveted. The lugs 38, 40 also include a laterally extending I-shaped portion which extends along the bottom of circuit board 12 and then up through respective openings 42, 44 (FIG. 2) in the circuit board 12 to a position located above the circuit board. Respective leads 46, 48 of the power cord 24 are connected to those portions of the lugs 38, 40 located above the circuit board 12 by any suitable means, for example, by soldering.

Referring to FIG. 1, leaf spring 34 is coupled to plug blade 20 by an eyelet 50 which extends through the circuit board 12 and is riveted thereto. The rightmost end of the leaf spring 34 as viewed in FIG. 1 extends through an opening 52 in the circuit board 12 to provide a more stable connection to the circuit board. The leaf spring 36 is similarly coupled to the circuit board 12 by a corresponding eyelet 54 (FIG. 2).

Figure 3:
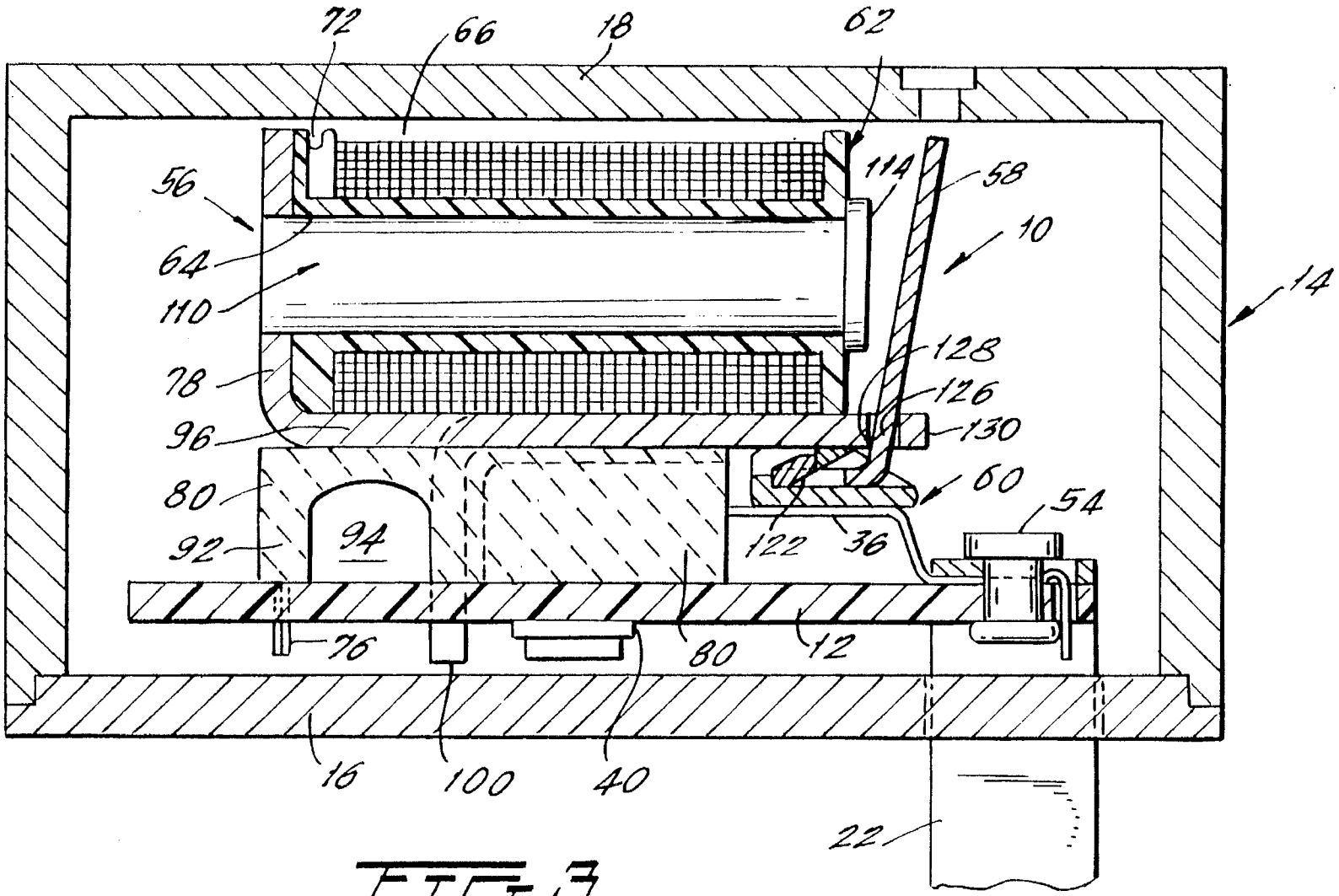
FIG. 3 is a cross section of the circuit breaker and plug housing taken along lines 3—3 of FIG. 2.

The spring force in leaf springs 34, 36 cause them to be normally in the positions illustrated in FIGS. 1 and 3 in the absence of any externally applied forces. In this position, the movable contacts 30, 32 are spaced from the stationary contacts 26, 28, respectively.

Figure 8:
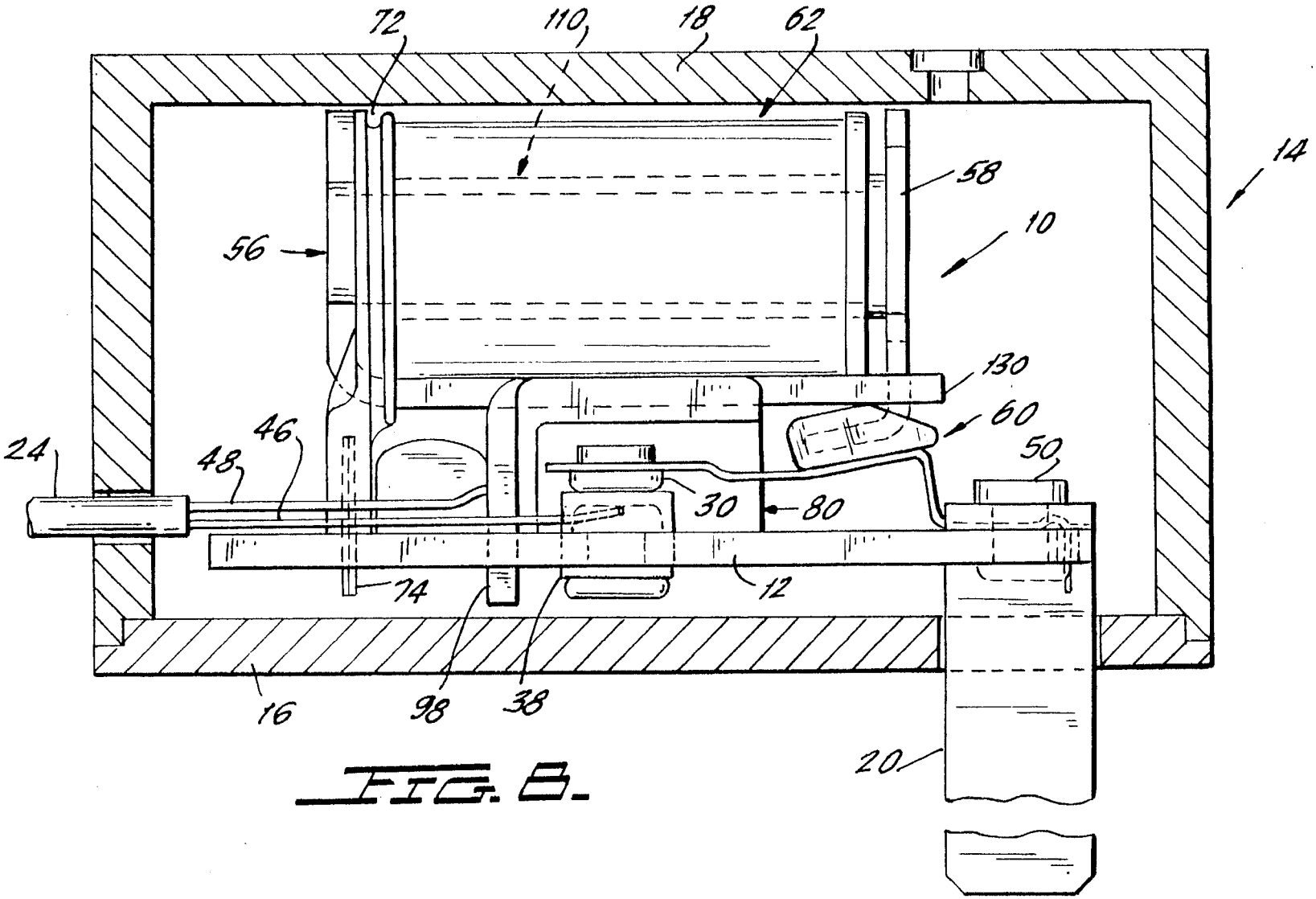
FIG. 8 is a side view of the circuit breaker similar to FIG. 1, but showing different positions of some of the parts.

When power is to be applied to the load coupled to power cord 24, a relay 56 forming part of the circuit breaker 10 is energized by the circuitry (e.g., a ground fault control circuit) mounted on the circuit board 12 causing the armature 58 to pivot counterclockwise from the open position illustrated in FIG. 1 to the closed position illustrated in FIG. 8. In this position, the cam member 60, which is coupled to the bottom end of armature 58, rotates from its generally horizontal orientation illustrated in FIG. 1 to its oblique orientation illustrated in FIG. 8 and deforms leaf springs 34, 36 into the position illustrated in FIG. 8. This moves the movable contacts 30, 32 into firm contact with the stationary contacts 26, 28, respectively. In the illustrated embodiment, the cam member 60 is designed to ensure that there is an over deformation in the leaf springs 34, 36 (that is, they are deformed beyond the position required to first place movable contacts 30, 32 into contact with stationary contacts 26, 28) in order to ensure a strong contact between the movable contacts 30, 32, and stationary contacts 26, 28, respectively.

The detailed structure and operation of relay 56 will now be described in more detail with particular reference to FIGS. 3 and 6.

The relay 56 includes a plastic bobbin 62 having a cylindrical section 64 on which the coil 66 is wound. Opposite ends of the coil 66 pass through a slot 68 (FIG. 6) formed in the back wall 70 of bobbin 62 and into the channel 72 formed at the rear of the bobbin 62. One end of the coil 66 extends down the left side of the channel 72 and is electrically connected to pin 74. The remaining end of coil 66 extends down the right side of channel 72 and is connected to pin 76. As best shown in FIGS. 1 and 3, pins 74, 76 extend through the circuit board 12. While not shown, the pins 74, 76 are connected to respective circuit board leads which are energized when the coil 66 is to be activated.

The plastic bobbin 62 is supported on a metallic frame 78 which in turn is supported by a plastic insulation piece 80 which sits on the top surface of circuit board 12.

The insulation piece 80 includes a planar support surface 82 and a pair of lateral edge guides 84, 86. The width of the portion of the support surface 82 located between lateral edge guides 84, 86 is equal to the width of the base section 96 of the metallic frame 78 which is seated on the insulation piece 80 to closely hold the frame 78 in place. The planar support surface 82 is maintained at a location above the circuit board 12 (so as to insulate the coil 66 from the circuit board) by a plurality of legs 88, 90, 92 extending downwardly from the support surface 82. A domed opening 94 is formed in the rear bottom portion of insulation piece 80 to permit the lead 48 of the power cord 24 to pass under the coil 66 so that it may be soldered or otherwise coupled to lug 40.

The metallic frame 78 includes a base section 96 which is received on the planar support surface 82 of insulation piece 80. A pair of downwardly projecting pins 98, 100 are formed integrally with the base section 96 and wrap around corresponding surfaces 102, 104 formed along the sides of insulation piece 80. As best shown in FIGS. 1 and 3, the pins 98, 100 extend through corresponding openings (unnumbered) in circuit board 12 and are connected to circuit board 12 in any appropriate manner.

The metallic frame 78 includes a rear section 106 having an opening 108 formed therein. Opening 108 receives the rear end of the metallic core 110 extending through a corresponding opening 112 in bobbin 62. The metallic core 110, the metallic support plate 96 and the metallic armature 58 cooperate to define a magnetic path for the flux generated by the coil 66 when current is passed through the coil. The magnetic flux will be concentrated at the front face 114 of the metallic core 110 forming a strong magnetic field which will draw the armature 58 from the open position illustrated in FIG. 1 to the closed position illustrated in FIG. 8.

Figures 6, 7:
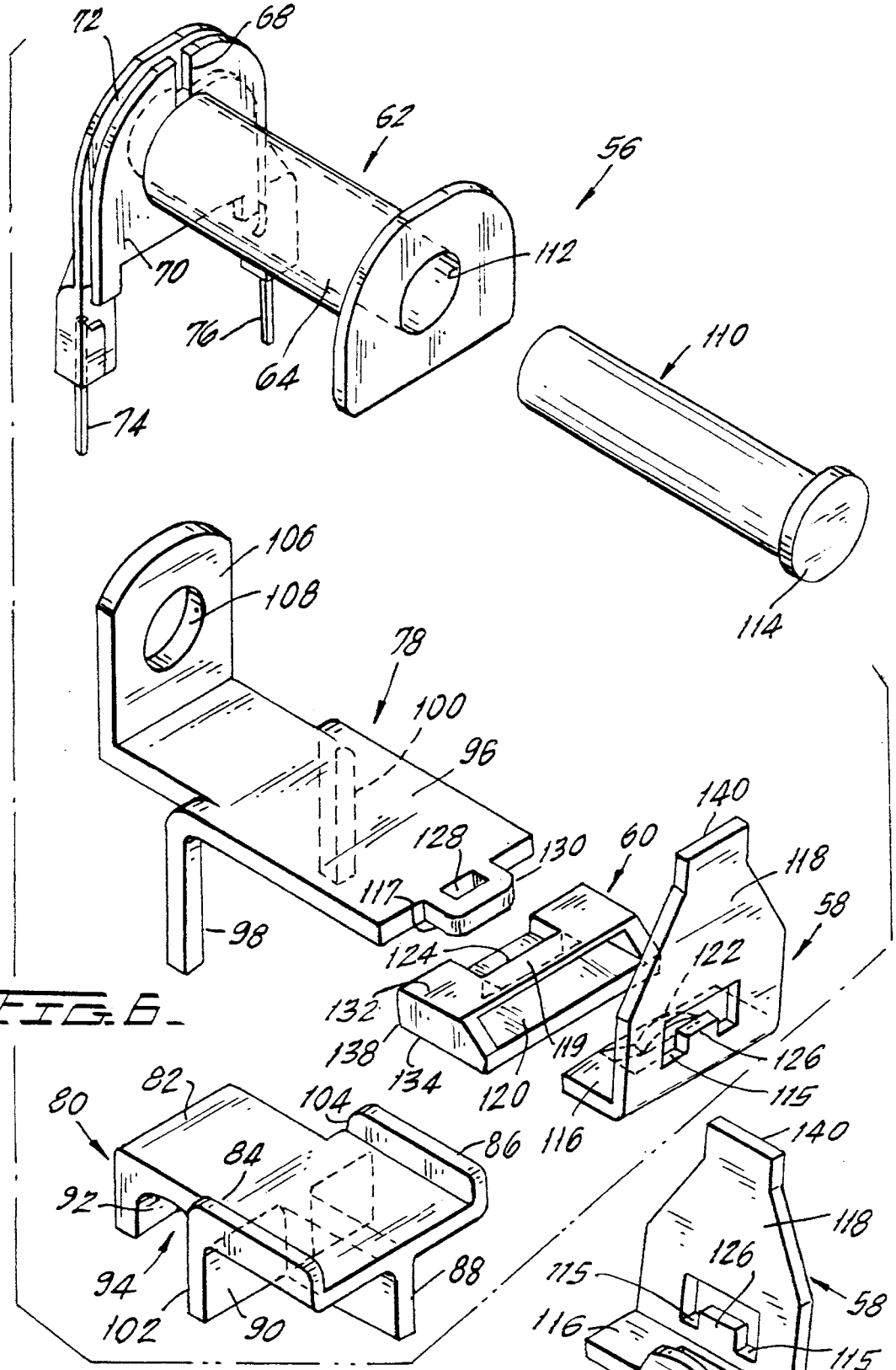
FIG. 6 is an exploded isometric view of the circuit breaker of FIG. 1, without the winding coils.
FIG. 7 is an isometric view of the actuator illustrated in FIG. 6.

As best shown in FIGS. 3, 6, and 7, the armature 58 is fixedly coupled to plastic cam member 60 and is hingedly coupled to the metallic frame 78. The armature 58 includes a foot portion 116 that is forced into the slot 120 in cam member 60, the upper wall 119 of cam member 60 will be deformed upwardly until the projection 122 is received in the slot 124 formed in the rear of cam member 60. As a result of this snap-fit arrangement, the cam member 60 is securely attached to the foot portion of 116 of armature 58.

As best shown in FIGS. 6 and 7, an inverted U-shape opening is formed in face portion 118 of armature 58 to form an upwardly projecting tongue 126. The tongue 126 is received in a corresponding groove 128 formed in a narrow projection 130 extending from the front end of metallic frame 78.

As best shown in FIGS. 1 and 3, the cam member 60 is pressed against the bottom of base section 96 of metallic frame 78 by the spring force of leaf springs 34, 36. As a result of the spring force, the tongue 126 formed in the face portion 118 of armature 58 is forced up through the groove 128 in frame 78. Since the upper and lower faces 132,134 (FIG. 6) of the cam member 60 are aligned parallel to one another, and since the face portion 118 of armature 58 forms an oblique angle with the foot portion 116 thereof, the face portion 118 of armature 58 will be spaced from front face 114 of core 110 whenever the coil 66 is not energized. When electrical current flows through the coil 66, the armature 58 pivots about a pivot point defined by the bottom portions 115 of the U-shaped opening in armature 58 and the bottom 117 of projection 130. As a result, the face portion 118 of armature 58 is drawn into contact with the front face 114 of core 110 causing the rear lower edge 138 of cam member 60 to rotate counterclockwise as viewed in FIGS. 1 and 3 thereby deforming leaf springs 34, 36 into the position illustrated in FIG. 8 and moving movable contacts 30, 32 into firm contact with stationary contacts 26, 28.

As best seen in FIGS. 1 and 6, the top of the front face 118 of armature 58 defines an indicator section 140 which is preferably painted with an easily visible color, such as iridescent orange. As best viewed in FIG. 1, a viewing opening 142 is formed in housing 14 at a location corresponding to the location of indicator section 140 when armature 58 is in the open position illustrated in FIG. 1. In the illustrated embodiment, a viewing lens 144 is located in the viewing opening 142. This lens may be a magnifying lens so as to make it easier to view the indicator section 140 through the opening 142.

When power is applied to the load, the armature 58 is located in the closed position illustrated in FIG. 8, and the indicator section 140 is moved away from the viewing opening 142. The user will not see the brightly colored indicator section 140 which will inform him that power is being applied to the load.

When power is cut off from the load, the armature 58 returns to the open position illustrated in FIG. 1 and the user can view the indicator section 140 through the viewing opening 142. In this position, the viewer will see the brightly colored paint located on the indicator section 40 which will let the viewer know that the circuit breaker is open and that power is disconnected from the load.

In one embodiment, the viewing opening 142 is placed at the location of the indicator section 140 when the armature 58 is in the open position. Alternatively, the viewing opening 142 can be located at the position of the indicator section when armature 58 is in the closed position. In such case, a bright color, such as green, is preferably used to indicate an OK condition-that is, that the circuit breaker is closed and power is being applied to the load.

Figure 9:
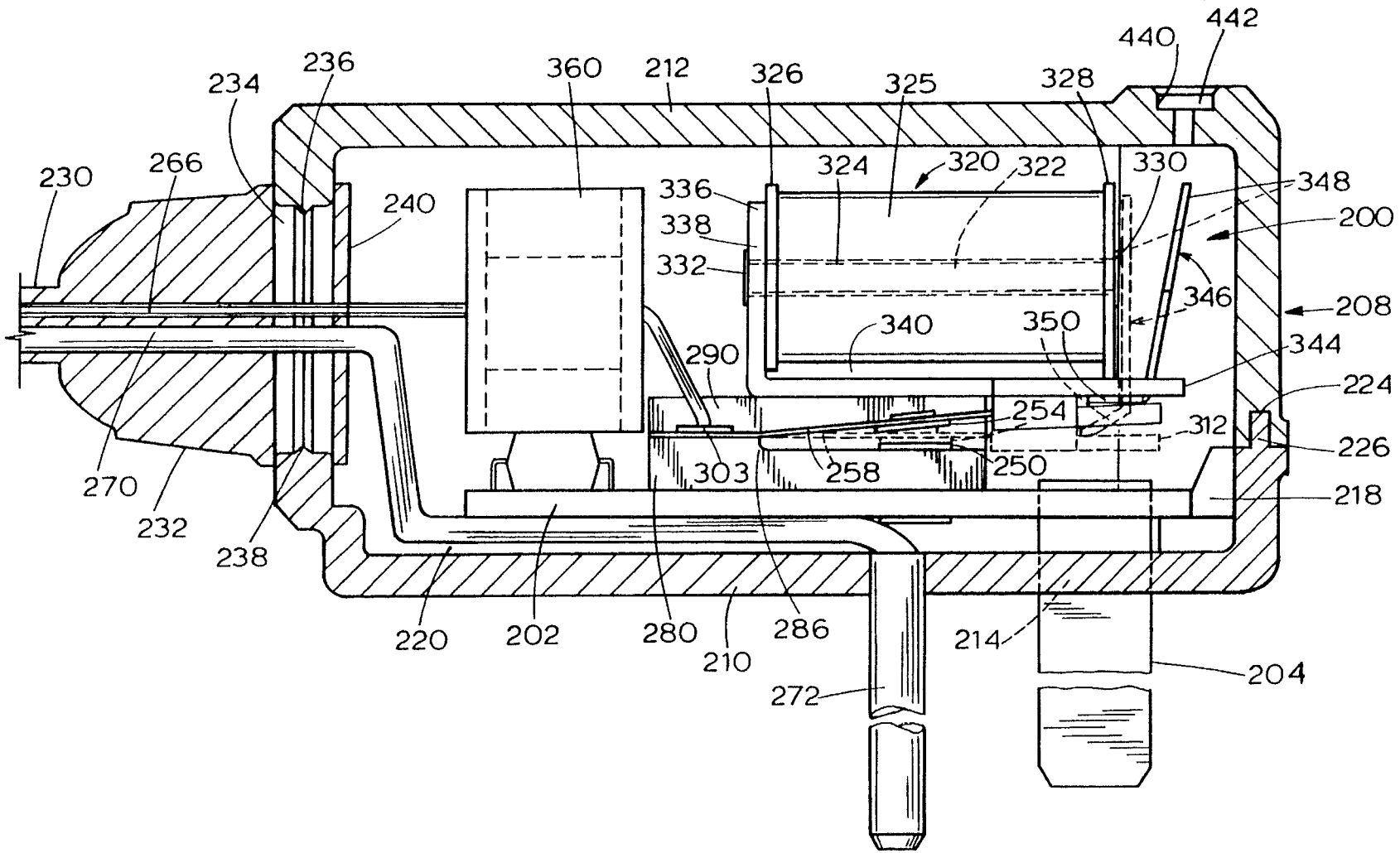
FIG. 9 is a side view of another embodiment of a circuit breaker of the present invention located in the housing of a wall plug, part of the housing of the wall plug being broken away.

FIG. 9 shows an alternative and preferred embodiment of a modular circuit breaker 200. In this embodiment, a circuit board 202 has all the necessary related electrical components described in the copending applications, mounted on it and coupled to it for ease of testing and manufacture. A first plug blade 204 and a second plug blade 206 (not illustrated) are mounted to the bottom of the circuit board 202 and soldered to an electrical circuit which is mounted on the circuit board 202. Similar to the embodiment described above, the circuit board 202 is mounted in a plug housing 208 having a base 210 and a cover 212, except that, in this embodiment, the plug blades 204 and 206 fit through matching slots in the housing base 210. A grounding post 272 is mounted directly to the housing base 210 at a position relative to the openings 214 and 216 through which the blades 204 and 206 pass so that when the circuit board 202 is mounted in the base 210, the blades and grounding post together are capable of being inserted into a standard female wall receptacle electrical power source. This arrangement proves less expensive to manufacture than mounting the post 272 to the circuit board 202, since the grounding post is not necessary to adequately test the modular circuit breaker prior to its installation in a housing.

The circuit board 202 engages resilient snap connectors 218 and 220 in the base 210. Ribs 222 in the housing cover 212 (see FIG. 14) also engage the circuit board 202 when assembled, to help ensure that the circuit board 202 stays in place even when jostled or abused.

Figure 12:
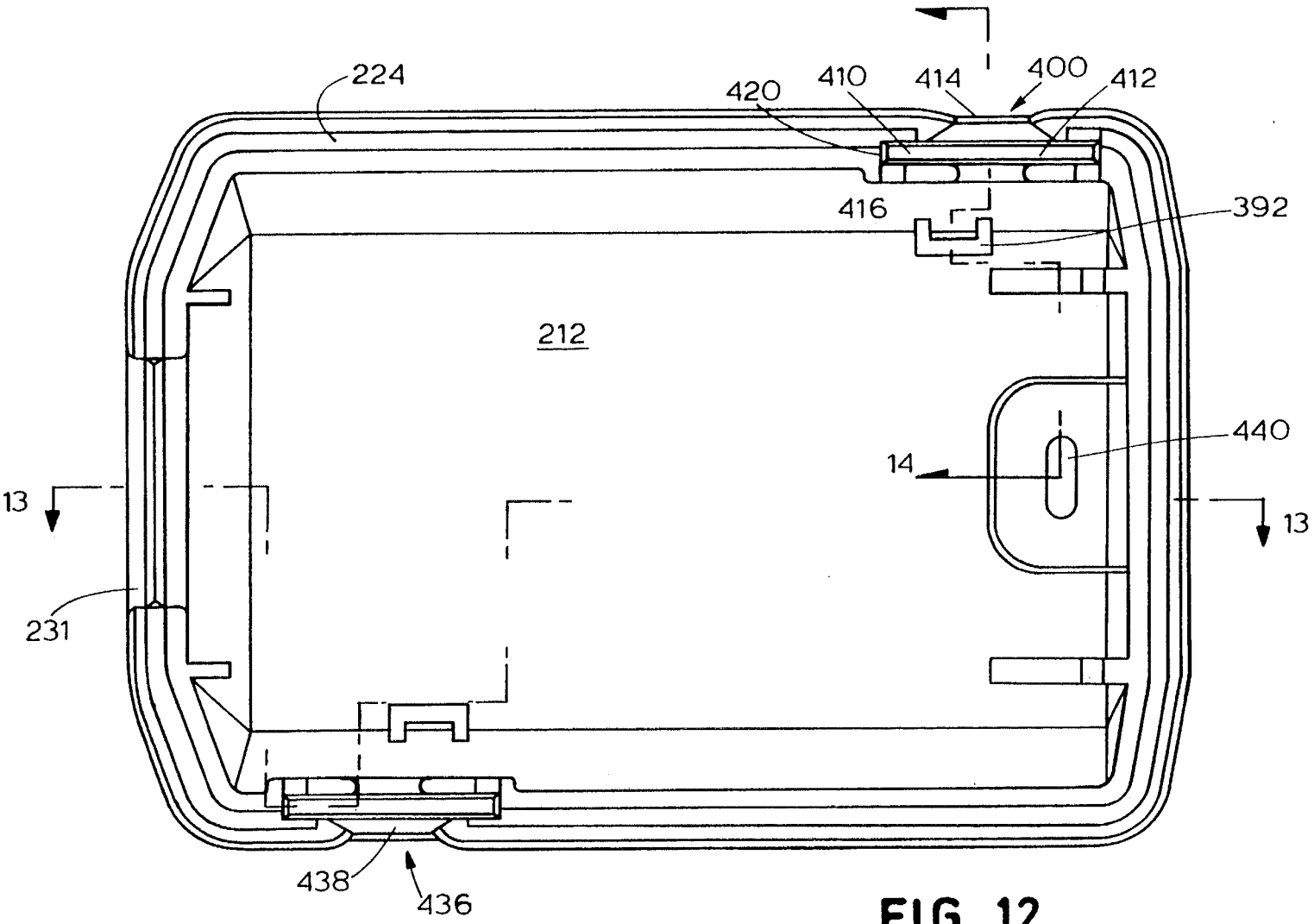
FIG. 12 is a plan view of the inside of a circuit breaker housing cover.

The cover 212 has a groove 224 formed around most of its periphery to match a corresponding peripheral tongue 226 in the base 210. Further, power cord 230 connected to the circuit breaker 200 preferably has a resilient collar 232 for anchoring the power cord to an opening 231 (see FIG. 12) in the rear of the housing 208. The collar 232 has formed in it a groove 234 which corresponds to a knife-edge tongue 236 formed in the cover 212 and a similar knife-edge tongue 238 in the base 210. A collar flange 240 engages the inside of the housing 208 around the periphery of the opening 231 while the collar 232 engages the outside of the housing 208 around the periphery of the opening to form a snug fit that inhibits the power cord 230 from being pulled out of or pushed into the housing 208 which could damage the circuit breaker 200. In addition, when the cover 212 is placed on the base 210 with the collar 232 secured in the opening, the tongue 226 and groove 224 arrangement between the cover 212 and the base 210 are preferably sonically welded to form a tight, durable, and water-resistant seam around the housing 208.

Figure 10:
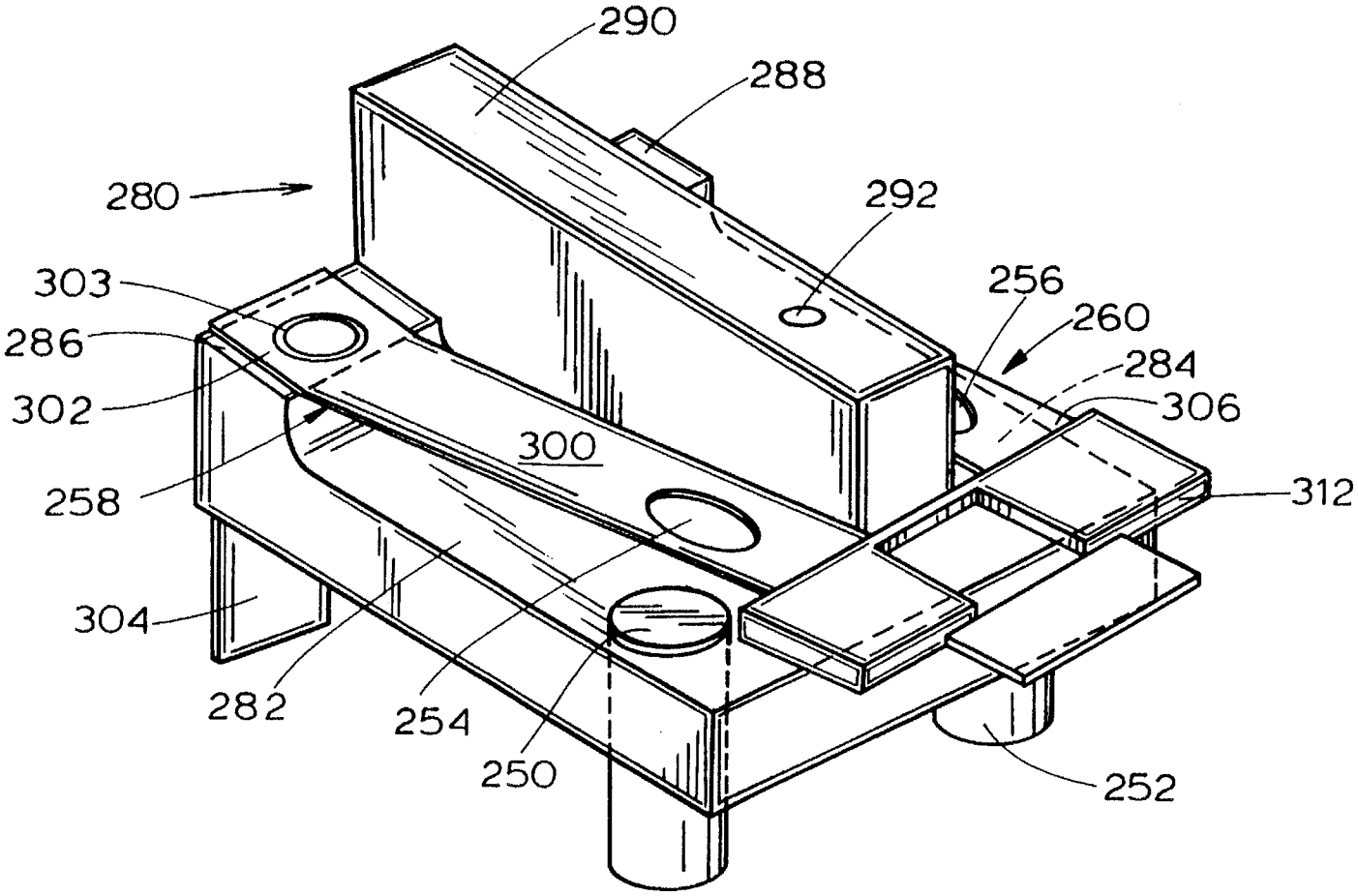
FIG. 10 is a perspective view of a switch platform supporting first and second normally open switches.

As viewed in FIGS. 9 and 10, the modular circuit breaker 200 includes a pair of stationary contacts 250 and 252 and movable contacts 254 and 256 coupled to respective leaf springs 258 and 260. Movable contact 254 and leaf spring 258 are also illustrated in FIG. 9 in phantom lines showing their positions relative to stationary contact 250 when a load is applied to the power cord 230. The stationary contact 250, the movable contact 254, and the leaf spring 258 together define a first normally open switch. The stationary contact 252, the movable contact 256, and the leaf spring 260 together form a second normally open switch. The first normally open switch is coupled between the first plug blade 204 and a first lead 266 of the power cord 230. The second normally open switch is coupled between the second plug blade 206 (not illustrated) and a second lead 268 of the power cord 230. In the normally open position, these switches cut off power to the load coupled to power cord 230. In the closed position (see phantom lines in FIG. 9), the switches couple electrical power to the load. A third lead 270 passing beneath the circuit board 202 is coupled directly to the grounding post 272.

As illustrated in FIG. 10, the first and second normally open switches are mounted on a single platform 280 which is preferably molded from any suitable insulating material such as plastic and is mounted on the top of the circuit board 202. The platform has first and second landings 282 and 284 positioned on a forward portion of the platform 280, and respective first and second rises 286 and 288 positioned on a rearward portion of the platform above the landings 282 and 284. The respective landings and rises are separated by a central barrier 290 having an upper flat surface positioned above both the landings 282 and 284, and the rises 286 and 288.

The stationary contact 250 extends through and is fixed to the first landing 282. An upper portion of the stationary contact 250 extends slightly above the first landing 282 for contacting the movable contact 254. A lower portion of the stationary contact 250 extends below the first landing 282 and through the circuit board 202. The stationary contact 250 is then soldered to the bottom of the circuit board 202 and is electrically coupled to the first plug blade 204.

The leaf spring 258 has a movable portion 300, a fixed portion 302, and a tail portion 304. The fixed portion 302 is riveted to the top of the first rise 286 with an eyelet 303, and the movable end 300 extends forward above the first landing 282 and above the stationary contact 250. The tail portion 304 extends downwardly off the rear of the first rise 286 and through the circuit board 202. It is soldered to the bottom of the circuit board 202 and is electrically coupled to the first lead 266 of the power cord 230. The movable contact 254 is joined to the movable portion of the leaf spring 258 at a position calculated to bring the movable contact 254 into contact with the stationary contact 250 when the leaf spring 258 is deformed downwardly.

Likewise, the stationary contact 252 extends through and is fixed to the second landing 284. An upper portion of the stationary contact 252 extends slightly above the second landing 284 for contacting the movable contact 256. A lower portion of the stationary contact 252 extends below the second landing 284 and through the circuit board 202 where it is connected and soldered so as to be electrically coupled to the second plug blade.

Like the leaf spring 258, the leaf spring 260 has a movable portion 306, a fixed portion (not illustrated), and a tail portion (not illustrated). The fixed portion of the leaf spring 260 is riveted to the second rise 288 by an eyelet (not illustrated), and the movable portion 306 extends forward above the second landing 282 and the stationary contact 252. The tail portion extends downwardly off the rear of the second rise 288 and through the circuit board 202 where it is connected and soldered so as to be electrically coupled to the second lead 268 of the power cord 230. The movable contact 256 is joined to the movable portion of the leaf spring 260 at a position calculated to bring the movable contact into contact with the stationary contact 252 when the leaf spring 260 is deformed downwardly.

The movable portions 300 and 306 of the leaf springs 258 and 260 are joined by a tab 312 made of insulating material so that they may be moved in unison by the tab 312 without short-circuiting the first and second normally open switches. The spring force in the leaf springs 258 and 260 causes them to be located in the upward position as illustrated in FIG. 10 in the absence of any externally applied forces. In this position, the movable contacts 254 and 256 will be spaced above the stationary contacts 250 and 252, respectively.

Figure 11:
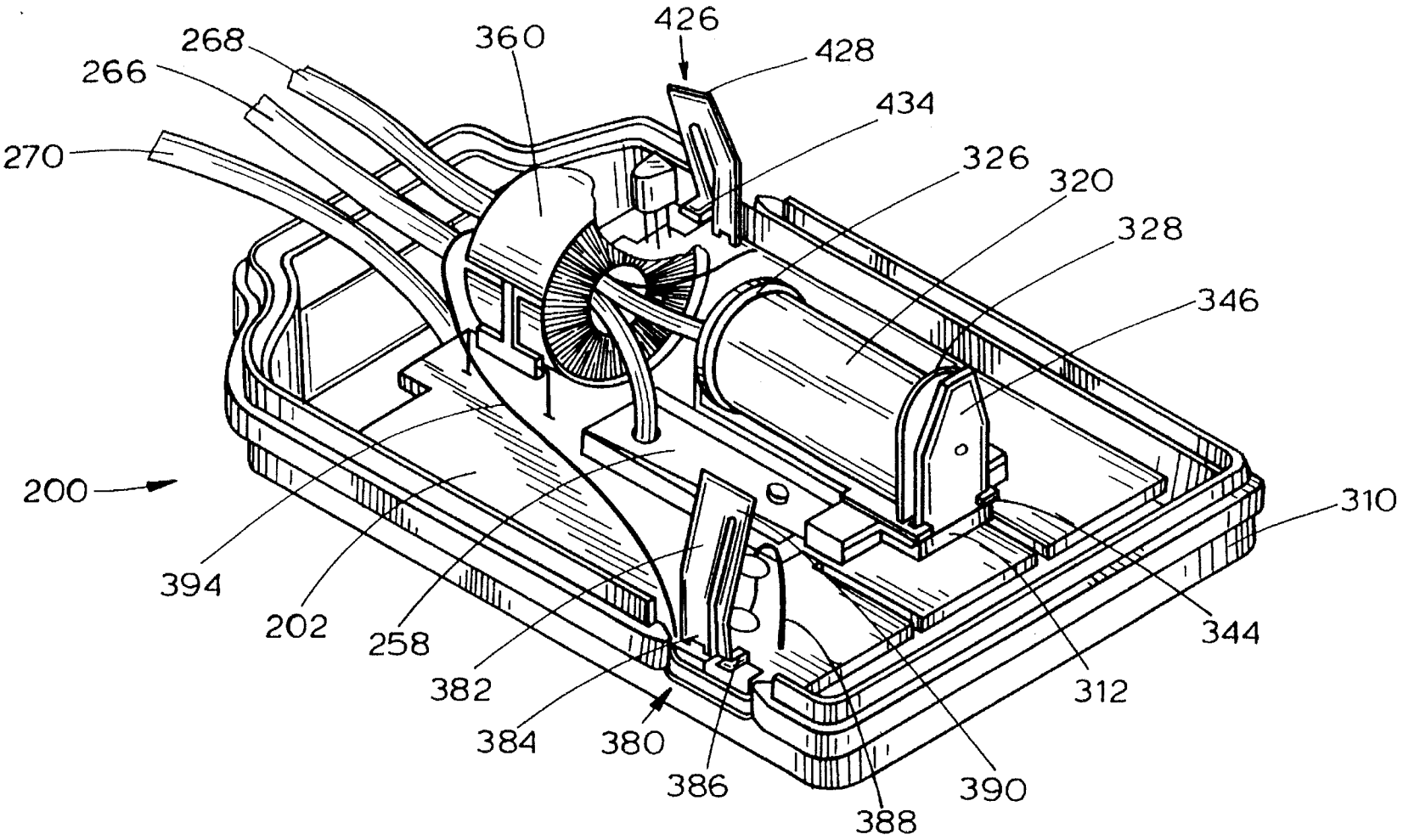
FIG. 11 is a perspective view of a circuit breaker of the present invention supported in a housing base.

FIGS. 9 and 11 illustrate a relay 320 forming part of the circuit breaker 200. As best seen in FIG. 9, the relay 320 has a central metallic core 322 surrounded by a plastic bobbin 324 on which a coil 325 is wound. The coil 325 is electrically coupled to the circuitry on the circuit board 202 from which it draws the necessary current to energize the relay 320. The metallic core 322 extends through a rear plastic end cap 326 and a forward plastic end cap 328. At the extremes of the metallic core are a forward lug 330 and a rear lug 332.

The relay 320 is mounted in a metallic frame 336 which has a rear vertical portion 338 positioned between the rear end cap 326 and the rear lug 332 so as to support the metallic core 322 and be in electrical contact with the metallic core 322 and the rear lug 332. The frame 336 also has a horizontal portion 340 which is positioned below the relay 320 and above the platform 280 which supports the first and second normally open switches. The horizontal portion 340 of the frame 336 is riveted to the central barrier 290 of the platform 280 at the hole 292 in the platform 280 (see FIG. 10). Further, the horizontal portion 340 of the frame 336 extends forward beyond the relay where it has a bracket 344 for supporting a metallic armature 346 (see FIG. 11).

The metallic armature 346 is positioned in the bracket 344 of the frame 336 so as to be free to pivot within the bracket. The armature 346 has an upright portion 348 and a lever portion 350 which are arranged at an oblique angle from one another. The upright portion 348 extends upwardly from the bracket 344, above the forward lug 330, to the top of the relay 320. The lever portion 350 is positioned below the horizontal portion 340 of the frame 336 and rests on the tab 312 which joins the movable ends of the leaf springs 258 and 260. Together, the relay 320, the metallic frame 336, and the armature 346 define a means for closing the first and second normally open switches.

When power is applied to the load coupled to the power cord 230, the relay 320 is energized by energizing circuitry (e.g., a ground fault control circuit) coupled to the circuit board 202, causing the armature 346 to pivot from a normally open position illustrated by the solid lines in FIG. 9 to the closed position illustrated by the dashed lines in FIG. 9. This occurs because the metallic core 322, the metallic frame 340, and the metallic armature 346, combine to define a magnetic path for the flux generated by the coil 325 when current is passed through the coil. The magnetic flux will be concentrated at the forward lug 330 forming a strong magnetic field which will draw the armature 346 from the open position illustrated by solid lines in FIG. 9 to the closed position illustrated by the dashed lines.

In the closed position, the lever action of the armature being drawn to the forward lug 330 of the metallic core 322 rotates the lever portion 350 downward to force the tab 312 and leaf springs 258 and 260 downward. This downward force by the oblique arrangement of the armature 346 causes movable contacts 254 and 256 to firmly contact stationary contacts 250 and 252, respectively, by over-deforming the leaf springs 258 and 260, thereby allowing current to flow from the power source through the first and second normally open switches to the load coupled to power cord 230 via first and second leads 266 and 268.

The modular circuit breaker 200 includes a fault sensing circuit coupled to the circuit board 202. The fault sensing circuit is intended to override the means for closing the first and second normally open switches. It includes a differential transformer 360 mounted to the top of the circuit board 202 to the rear of the relay 320. The first and second leads 266 and 268 of the power cord 230 pass through a central opening in the differential transformer 360 and are connected to the circuit board 202 after passing through the eyelets 303 that anchor the leaf spring fixed portions. In operation, when there is an imbalance in the currents in the first and second leads 266 and 268, the differential transformer 360 will sense the imbalance and, through the relay 320 and the circuitry mounted on the circuit board 202, cut off current to the coil 325, thereby deenergizing the relay 320, collapsing the magnetic flux to release the armature 346 from the relay 320. When this occurs, the leaf springs 258 and 260 move upward, opening the first and second normally open switches to cut off power to the load on the power cord 230.

Together, the combination of the circuit board 202 supporting the plug blades, the first and second normally open switches, the relay 320, the armature 346, and the fault sensing circuit, including differential transformer 360, define a modular circuit breaker unit that is easily and inexpensively manufactured and tested. If any component were mounted or supported remotely from the circuit board 202 (for example by the housing 208), then reliable testing of the unit could not take place until assembly of the circuit board in the housing is complete. If the unit is unsatisfactory, then costly steps in the manufacturing process are wasted. This is particularly wasteful when the housing base 210 and the housing cover 212 are sonically welded together because the housing of an unsatisfactory circuit breaker 200 must be discarded.

As illustrated in FIG. 11, a means for testing the circuit breaker 200 is provided in the form of a test switch 380 for simulating a current imbalance in first and second leads 266 and 268. The test switch 380 includes a leaf spring 382 made of electrically conducting material in a preferably inverted U-shaped configuration. A fixed leg 384 of the leaf spring 382 is mounted on the circuit board 202 while a free leg 386 is unrestrained for movement in and out relative to an electrical component 388 which is mounted on the circuit board and is capable of providing a flow of current to the leaf spring 382. The top of the leaf spring 390 is adapted to engage and be restrained by a slot 392 molded on the inside of the housing cover 212. The test switch 380 also includes a wire lead 394 electrically coupled to the fixed leg 384 of the leaf spring 382. The wire lead 394 passes through the central passage of the differential transformer 360 and is connected to the circuit board 202.

Figure 14:
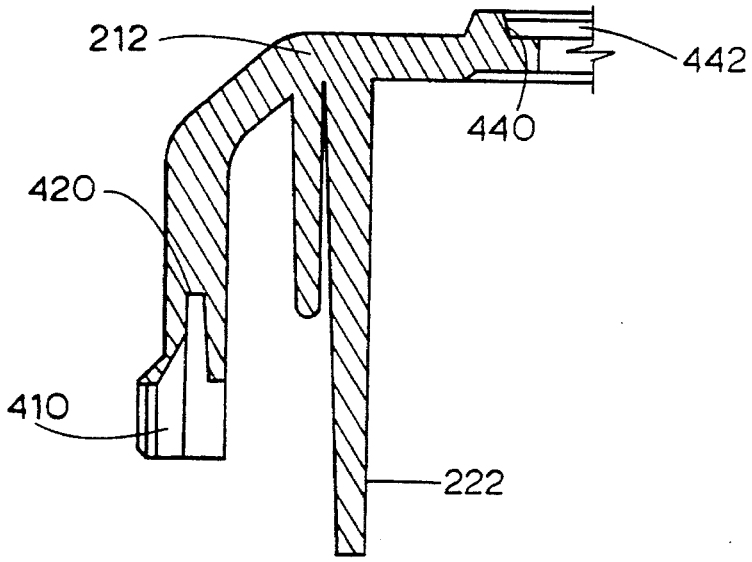
FIG. 14 is a sectional view of the housing cover illustrated in FIG. 12 taken along line 14—14.
Figure 13:
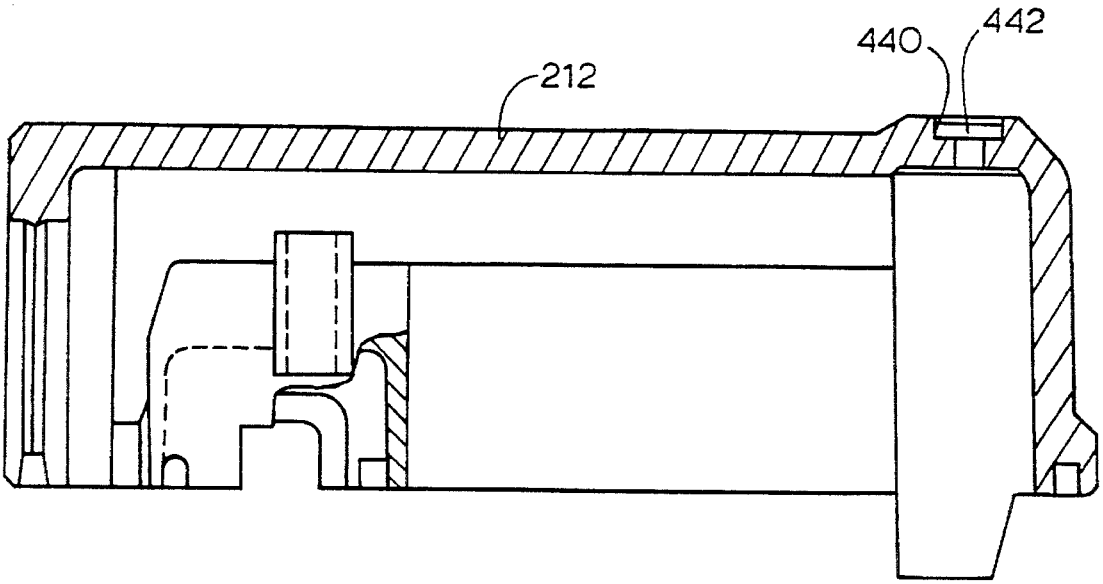
FIG. 13 is a sectional view of the housing cover illustrated in FIG. 12 taken along line 13—13.

The free leg 386 of the leaf spring 382 is positioned near a test switch opening 400 in the housing 208. The test switch opening 400 is defined by matching rectangular notches in both the housing base 210 and the housing cover 212. The test switch opening is covered by a resilient seal 410 (illustrated in FIG. 12) preferably made of an insulating material such as plastic or rubber. The test switch seal 410 is rectangular and has a peripheral flange 412 surrounding a raised button 414. The button 414 is exposed through opening 400 in the housing 208 for manual operation by a user. On the opposite side of seal 410 from the button 414 is a pin 416 which is advantageously positioned to contact the free leg 386 of the leaf spring 382. The flange 412 of the seal 410 is adapted to fit into slots 420 formed in the housing base 210 and the housing cover 212 as illustrated in FIG. 14. The slots restrain the seal 410 from falling out of the housing 208 and provide a water-resistant interface between the seal 410 and the housing 210.

To test the modular circuit breaker 200, when a load is applied to the power cord 230, the user presses the button 414, forcing the pin 416 into the free leg 386 of the leaf spring 382 into contact with electrical component 388. The electrical component 388 sends a current through the leaf spring 382 to wire lead 394 which simulates an imbalance in the first and second leads 266 and 268. This simulated imbalance should override the energizing circuit for the relay 320 and deenergize it, thereby opening the circuit breaker 200.

A means for resetting the fault sensing circuit is also provided in the form of a reset switch 426. After correction of a fault, the reset switch 426 enables the user to apply a reset signal to the fault sensing circuit to reclose the circuit breaker 200 and reestablish connection between the wall receptacle power source and the load on the power cord 230. The reset switch 426 is similar to the test switch 380 in that it uses a nearly identical U-shaped leaf spring 428 with a fixed leg mounted to the circuit board and a free leg able to move in and out relative to an electrical component 434 which sends the reset signal to the fault sensing circuit.

The reset switch 426 is positioned near an opening 436 in the housing 208. The opening 436 is defined by two matching rectangular notches in the housing base 210 and the housing cover 212. The opening is covered by a seal 438 as described above.

To reset the circuit breaker fault sensing circuit, the user presses the button of the seal to contact the electrical component 434 which sends a signal through the leaf spring 428 to the fault sensing circuit thereby reestablishing contact between the power source and the load.

The modular circuit breaker 210, together with the testing switch and reset switch, both mounted on the circuit board 200, provides further advantages in the manufacture and quality control testing of the present invention because all of the circuit breaker functions can be tested prior to being assembled in a housing or other enclosure.

In this embodiment of circuit breaker 200, the top of the armature 346 is preferably painted with an easily visible color, such as iridescent orange. A viewing opening 440 is formed in the housing cover 212 at a location corresponding to the location of top of the armature 346 when in the open position as illustrated by the solid lines in FIG. 9. A viewing lens 442 is located in the viewing opening 440. This lens may be a magnifying lens so as to make it easier to view the painted top of the armature 346 through opening 440.

When power is being supplied to the load, the armature 346 is located in the closed position in contact with the relay 320. In this position, the top of the armature 346 is not visible through opening 440. Conversely, when the armature is in the open position, the top of the armature 346 is visible, indicating to the user that a fault has occurred.

The foregoing structures provide a very simple, reliable, and inexpensive circuit breaker with the minimum of movable parts. The circuit breaker can be constructed very compactly so as to fit within the housing of a wall plug while retaining full electrical capacity, low manufacturing costs, and reliable, fully automatic operation.

In addition, the structure illustrated in FIG. 9, is modular and therefore capable of being tested prior to assembly in the housing. This modular construction provides both efficiency and lower costs in the manufacturing process.

The present invention may be embodied in other specific forms without departing from the spirit or essential attributes thereof, and, accordingly, reference should be made to the appended claims, rather than to the foregoing specification, as indicating the scope of the invention.

What is claimed is:

1. A circuit breaker comprising:

a normally open switch including first and second contacts and a movable leaf spring supporting said first contact; said leaf spring normally being oriented in a first position wherein said first contact is not in electrical contact with said second contact and being deformable into a second position wherein said first contact is in electrical contact with said second contact;

an armature movable between an open position and a closed position;

an electrical coil for generating a magnetic field which moves said armature into said closed position when said coil is energized;

a support member upon which said coil is mounted wherein said armature is hingedly and removably coupled to said support member by a tongue and groove arrangement and wherein said tongue is normally biased into said groove by said leaf spring; and a cam member coupled between said armature and said leaf spring, wherein said cam member has a cam surface which contacts said support member;

said leaf spring biasing said armature toward said open position and said cam member being moved into a first position by said leaf spring when said coil is not energized, said armature causing said leaf spring to deform into said second position and said cam member to move into a second position so as to place said first contact into electrical contact with said second contact when said coil is energized.

2. The circuit breaker of claim 1, further including a conductive core extending through said coil and wherein said support member and said armature are formed of conductive materials and cooperate with said core to define a magnetic path for flux generated by said coil when said coil is energized.

3. The circuit breaker of claim 2, further including a nonconductive bobbin on which said coil is wound, said bobbin being supported on said support member, said core extending through said bobbin and being separated from said coil by said bobbin.

4. The circuit breaker of claim 3, wherein said support member is mounted on a circuit board via an insulation member which supports said support member at a position spaced from said circuit board.

5. The circuit breaker of claim 1, further including means for enhancing the visibility of said armature so that said armature provides a visual indication of whether said normally open switch is in said opened or closed position.

6. The combination, comprising:

a circuit board having electronic components coupled thereto; and a circuit breaker mounted on said circuit board, said circuit breaker including a normally open switch including first and second contacts and a movable leaf spring supporting said first contact, said leaf spring normally being oriented in a first position wherein said first contact is not in electrical contact with said second contact and being deformable into a second position wherein said first contact is in electrical contact with said second contact, an armature movable between an open position and a closed position, an electrical coil for generating a magnetic field which moves said armature into said closed position when said coil is energized, a support member upon which said coil is mounted wherein said armature is hingedly and removably coupled to said support member by a tongue and groove arrangement and wherein said tongue is normally biased into said groove by said leaf spring, and a cam member coupled between said armature and said leaf spring wherein said cam member has a cam surface which contacts said support member, said leaf spring biasing said armature toward said open position and said cam member being moved into a first position by said leaf spring when said coil is not energized, said armature causing said leaf spring to deform into said second position and said cam member to move into a second position so as to place said first contact into electrical contact with said second contact when said coil is energized.

7. The combination of claim 6, further including a conductive core extending through said coil and wherein said support member and said armature are formed of conductive materials and cooperate with said core to define a magnetic path for flux generated by said coil when said coil is energized.

8. The combination of claim 7, further including a nonconductive bobbin on which said coil is wound, said bobbin being supported on said support member, said core extending through said bobbin and being separated from said coil by said bobbin.

9. The combination of claim 8, further including an insulation member for supporting said support member at a position spaced from said circuit board.

10. The combination of claim 6, further including means for enhancing the visibility of said armature so that said armature provides a visual indication of whether said normally open switch is in said open or closed position.

11. A plug adapted to engage a wall-mounted receptacle, the plug having a circuit breaker mounted therein, comprising:

a housing;

a pair of plug blades extending from a position inside said housing to a position outside of said housing;

a power cord extending from a position internally of said housing to a load externally of said housing, said power cord having first and second power leads; and a circuit breaker located in said housing for selectively electrically coupling said plug blades to said power cord, said circuit breaker including a pair of normally open switches, each of said switches being coupled between a respective said plug blade and a respective said power lead, each of said switches including first and second contacts and a movable leaf spring supporting said first contact, said leaf spring normally being oriented in a first position wherein said first contact is not in electrical contact with said second contact and being deformable into a second position wherein said first contact is in electrical contact with said second contact wherein one of said first and second contacts is electrically coupled to its respective said plug blade and the other of said first and second contacts is electrically coupled to its respective said power lead, an armature movable between an open position and a closed position, an electrical coil for generating a magnetic field which biases said armature toward said closed position when said coil is energized, a support member upon which said coil is mounted wherein said armature is hingedly and removably coupled to said support member by a tongue and groove arrangement and wherein said tongue is normally biased into said groove by said leaf spring, and a cam member coupled between said armature and said leaf springs wherein said cam member has a cam surface which contacts said support member;

said leaf springs biasing said armature toward said open position and said cam member being moved into a first position by said leaf spring when said coil is not energized, and said armature causing said leaf springs to deform into their respective second positions and said cam member to move into a second position so as to place each of said first contacts into electrical contact with its associated second contact when said coil is energized.

12. The plug of claim 11, further including a conductive core extending through said coil and wherein said support member and said armature are formed of conductive materials and cooperate with said core to define a magnetic path for flux generated by said coil when said coil is energized.

13. The plug of claim 12, further including a nonconductive bobbin on which said coil is wound, said bobbin being supported on said support member, said core extending through said bobbin and being separated from said coil by said bobbin.

14. The plug of claim 13, wherein said support member is mounted on a circuit board located in said housing via an insulation support member which supports said support member in a position spaced from said circuit board.

15. The plug of claim 11, further including a viewing opening formed in said housing for viewing the position of said armature so that said armature provides a visual indication of whether said normally open switches are in said opened or closed position.

16. The plug of claim 15, further including means for enhancing the visibility of said armature.

17. The plug of claim 16, wherein said means for enhancing comprises an easily visible paint placed on at least a portion of said armature.

* * * * *